US011944160B1

(12) United States Patent
Jamison et al.

(10) Patent No.: US 11,944,160 B1
(45) Date of Patent: Apr. 2, 2024

(54) INSERT FOR SUPPORTING AND AERATING A SHOE STRUCTURE

(71) Applicant: Kingsland Shoe Project, LLC, Redlands, CA (US)

(72) Inventors: Garrett Jamison, Redlands, CA (US); Ryan Jamison, Redlands, CA (US)

(73) Assignee: Kingsland Shoe Project, LLC, Redlands, CA (US)

( * ) Notice: Subject to any disclaimer, the term of this patent is extended or adjusted under 35 U.S.C. 154(b) by 0 days.

(21) Appl. No.: 18/328,727

(22) Filed: Jun. 3, 2023

(51) Int. Cl.
*A43B 7/08* (2022.01)
*A43D 3/14* (2006.01)

(52) U.S. Cl.
CPC ..... *A43B 7/085* (2013.01); *A43D 3/1416* (2013.01); *A43D 3/1433* (2013.01)

(58) Field of Classification Search
CPC ..... A43B 7/085; A43B 7/08; A43B 23/081; A43D 3/02–029; A43D 3/1433; A43D 3/1416; A43D 3/1491
See application file for complete search history.

(56) References Cited

U.S. PATENT DOCUMENTS 445,360 A * 1/1891 Woodard ..... A43D 3/1433 12/128 R
1,862,168 A * 6/1932 Weiskotten ..... A43D 3/1416 12/114.8
1,971,247 A * 8/1934 Badoux ..... A43D 3/1491 12/128 B
2,408,545 A * 10/1946 Barber ..... A43D 3/1433 12/116.8
2,417,589 A * 3/1947 Desrosiers ..... A43D 3/1433 12/117.2
2,446,904 A * 8/1948 Brush ..... A43D 3/1491 12/128 B
2,510,315 A * 6/1950 Malberg ..... A43D 3/1491 12/128 B
5,230,115 A * 7/1993 Hollister ..... A43D 3/00 12/128 B
5,946,823 A * 9/1999 Yates ..... A43B 7/26 36/94
5,978,996 A * 11/1999 Ullman ..... A43D 3/1491 12/128 B
10,729,207 B1 * 8/2020 Luna ..... A43B 23/24
RE49,279 E * 11/2022 Abadjian ..... A43B 3/14 D2/916

(Continued)

*Primary Examiner* — Katharine G Kane
(74) *Attorney, Agent, or Firm* — Tatonetti IP

(57) ABSTRACT

A shoe insert is configured as a single component with a specifically-configured shape that provides internal shoe structural support while enhancing airflow within the shoe. The shoe insert is comprised of a rigid structure, such as plastic, that engages with the inner and outer sides of the shoe to provide sufficient support. The shoe insert's inner and outer sides, which engage with the shoe's inner and outer sides, have a grip portion with an upper opening substantially positioned at the shoe's ankle opening. This upper opening enables air to flow therethrough and provide breath to the shoe's interior cavity. Airflow holes spread sporadically throughout the shoe insert's body enables air to flow through the shoe insert and engage the shoe to provide breathability, thereby preventing moisture, mold, and stench.

8 Claims, 12 Drawing Sheets

(56) References Cited

U.S. PATENT DOCUMENTS

2004/0128862 A1* 7/2004 Flack ..... A43C 11/12 36/100
2005/0016023 A1* 1/2005 Burris ..... B29D 35/146 36/55
2006/0277785 A1* 12/2006 Vattes ..... A43B 17/102 36/3 A
2006/0277786 A1* 12/2006 Vattes ..... A43B 23/26 36/3 A
2007/0180730 A1* 8/2007 Greene ..... B29D 35/146 36/3 R
2007/0256328 A1* 11/2007 Arizumi ..... A43B 7/08 12/146 C
2009/0065716 A1* 3/2009 Ullman ..... A43D 3/1491 250/504 R
2010/0077638 A1* 4/2010 Simms ..... A43B 5/185 36/7.1 R
2010/0325817 A1* 12/2010 Siragusa ..... A43B 23/087 12/128 B
2011/0185598 A1* 8/2011 Tsen ..... A43B 3/16 36/135
2011/0185602 A1* 8/2011 Kurth ..... A43B 3/0057 36/77 R
2012/0317841 A1* 12/2012 Taylor ..... A43B 3/0084 36/103
2014/0059887 A1* 3/2014 Lawlor ..... A43B 7/1425 36/83
2014/0090274 A1* 4/2014 Arquilla ..... A43B 13/14 36/43
2014/0352179 A1* 12/2014 Bell ..... A43B 23/0245 66/170
2015/0289597 A1* 10/2015 Li ..... A43B 3/36 12/133 R
2016/0213090 A1* 7/2016 Nakano ..... A43B 23/0245
2016/0227880 A1* 8/2016 Champagne ..... A43B 5/1641
2016/0331068 A1* 11/2016 Bigolin ..... A43B 7/085
2016/0332063 A1* 11/2016 Van Horne ..... A43B 23/0215
2018/0213884 A1* 8/2018 Kim ..... A43B 13/127
2018/0271209 A1* 9/2018 Zahrieh ..... A61H 39/007
2019/0116924 A1* 4/2019 Darby ..... A43B 3/128
2019/0116925 A1* 4/2019 Darby ..... A43B 7/1405
2019/0239594 A1* 8/2019 Bell ..... A43B 7/1425
2020/0015542 A1* 1/2020 Hsu ..... A43B 23/022
2020/0187588 A1* 6/2020 Rosenberg ..... A43B 7/125
2020/0205480 A1* 7/2020 Giorgi ..... D04B 1/28
2020/0275729 A1* 9/2020 Sackett ..... A43B 5/12
2021/0138335 A1* 5/2021 Yeh ..... A43B 7/087
2021/0227924 A1* 7/2021 Oroszi ..... A43B 23/0235
2023/0064528 A1* 3/2023 Lai ..... A43B 9/02
2023/0210218 A1* 7/2023 Pence ..... A43C 7/00 36/11

* cited by examiner

105

105

105

105

INSERT FOR SUPPORTING AND AERATING A SHOE STRUCTURE

BACKGROUND

Shoe trees and inserts tend to be overly complex and heavy, stretch out the shape, and inhibit proper airflow, leading to excessive moisture, odor, and unnecessary degradation of the shoe's materials.

SUMMARY

A shoe insert is configured as a single component with a specifically-configured shape that provides internal shoe structural support while enhancing airflow within the shoe. The shoe insert is comprised of a rigid structure, such as plastic, that engages with the inner and outer sides of the shoe to provide sufficient support. Although plastic is shown and described, other materials are also possible, such as metal, wood, silicone, rubber, or other suitable polymer. The shoe insert's inner and outer sides, which engage with the shoe's inner and outer sides, have a grip portion with an upper opening substantially positioned at the shoe's ankle opening. This upper opening enables air to flow therethrough and provide breath to the shoe's interior cavity. Airflow holes spread sporadically throughout the shoe insert's body enables air to flow through the shoe insert and engage the shoe to provide breathability, thereby preventing moisture, mold, and stench.

This Summary is provided to introduce a selection of concepts in a simplified form that is further described below in the Detailed Description. This Summary is not intended to identify key features or essential features of the claimed subject matter, nor is it intended to be used as an aid in determining the scope of the claimed subject matter. Furthermore, the claimed subject matter is not limited to implementations that solve any or all disadvantages noted in any part of this disclosure. These and various other features will be apparent from a reading of the following Detailed Description and a review of the associated drawings.

DESCRIPTION OF THE DRAWINGS

Like reference numerals indicate like elements in the drawings. Elements are not drawn to scale unless otherwise indicated.

DETAILED DESCRIPTION

Figure 1:
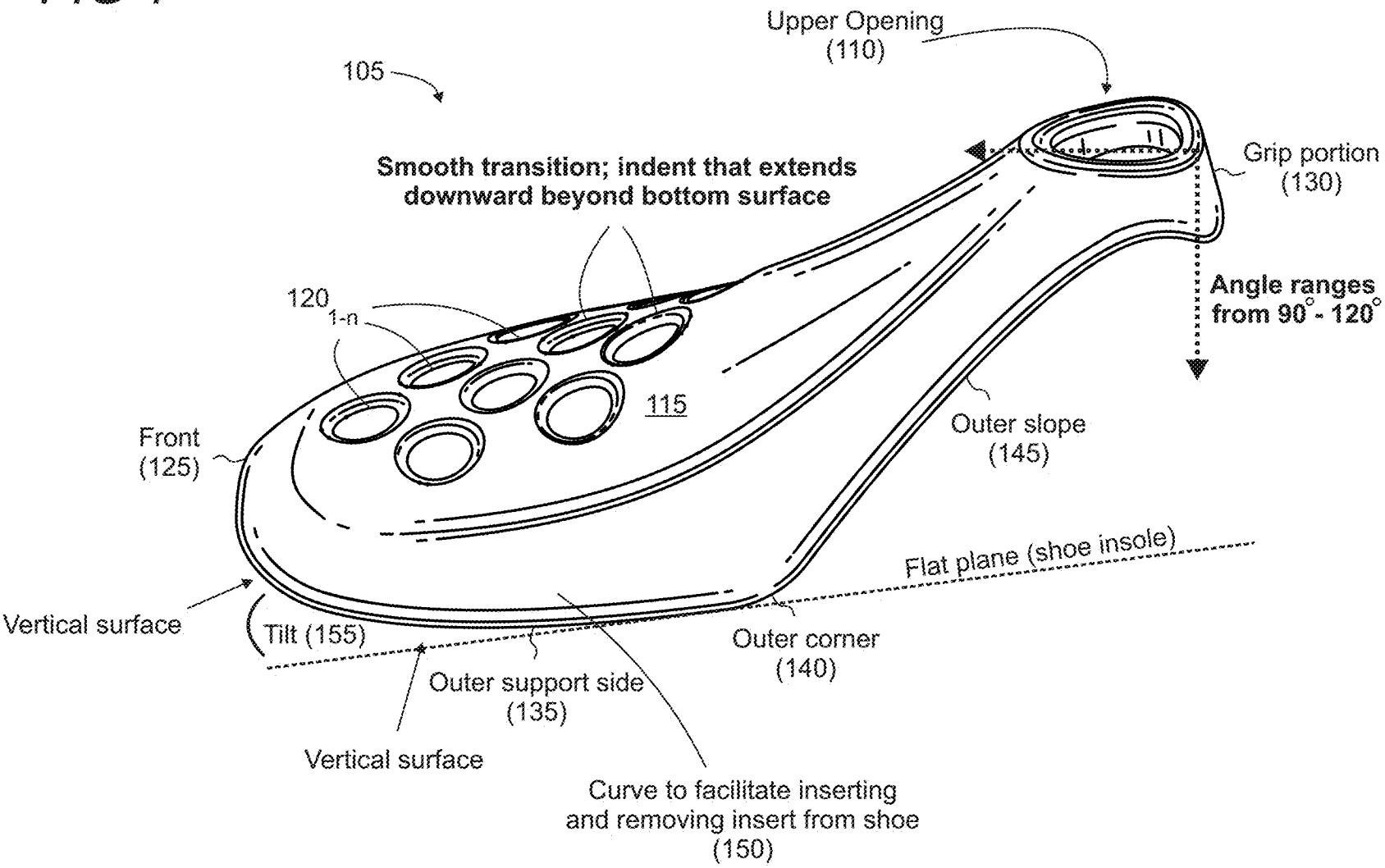
FIG. 1 shows an illustrative representation of an outer side of the shoe insert.
Figure 2:
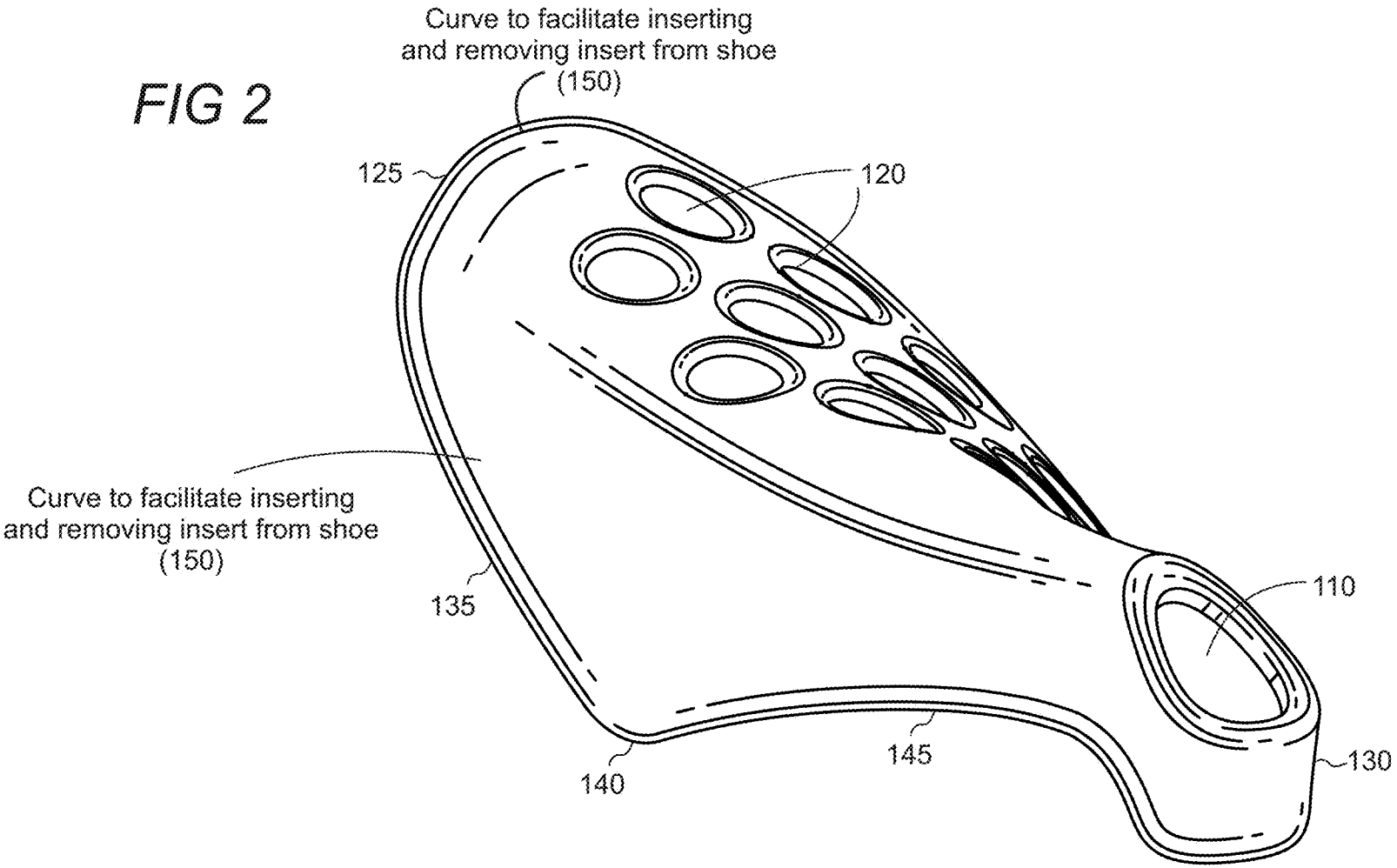
FIG. 2 shows an illustrative representation of the top and outer side of the shoe insert.

FIGS. 1 and 2 show illustrative representations in which a shoe insert 105 has a grip portion 130, an outer slope 145 leading from the grip portion, an outer corner 140, and an outer support side 135 that leads to the front 125 of the shoe insert. As shown, the end or bottom of the shoe insert are vertical services such that the smooth transition from the grip portion 130 leads to a substantially vertical support. This vertical support of the end or bottom portion can rest against a bottom surface of a user's shoe while also outwardly supporting the upper and side portions of the user's interior shoe. Furthermore, the sides of the shoe insert is configured with unique curves 150 that helps facilitate the user's ability to easily slide in the insert and remove the insert. The curved regions 150 on the inner and outer support sides 315, 135 are shown throughout the drawings.

FIG. 1 shows a horizontal flat plane represented by a broken line. This may be the surface of a shoes insole. As shown, the shoe insert 105, when inserted into a shoe structure, provides a slight upward tilt at the front 125 of the shoe structure, which may help prevent the shoe insert from, for example, catching on the insole when removing the insert. The title comes about by the overall shape and structure of the shoe, and the slightly increased weight near the rear end of the shoe (i.e., opposite front 125).

The front portion has a series of airflow holes 120 spread across its body to enable air to flow and engage with the shoe's interior surface. Such airflow holes prevent the shoe from becoming moist, having an odor, and degrading.

The grip portion 130 has an upper opening 110, which provides a place for the user to grab the shoe insert and allows air to flow down into the shoe. Airflow through the upper opening allows air to touch the shoe's bottom surface and extend through the airflow holes 120, thereby touching the upper portions of the shoe's surface. The outer slope 145 ends at an outer corner 140 which leads to the outer support side 135 that touches an outer surface of the user's shoe. The shoe insert's outer support side and front 125 are shaped to correspond to typical shoe shapes. As shown, the grip portion 130 forms an obtuse angle relative, but depending on the specific design could range anywhere from 90° to 120°. Nonetheless, other angles greater or lesser are also possible if the grip portion is satisfied.

Figure 3:
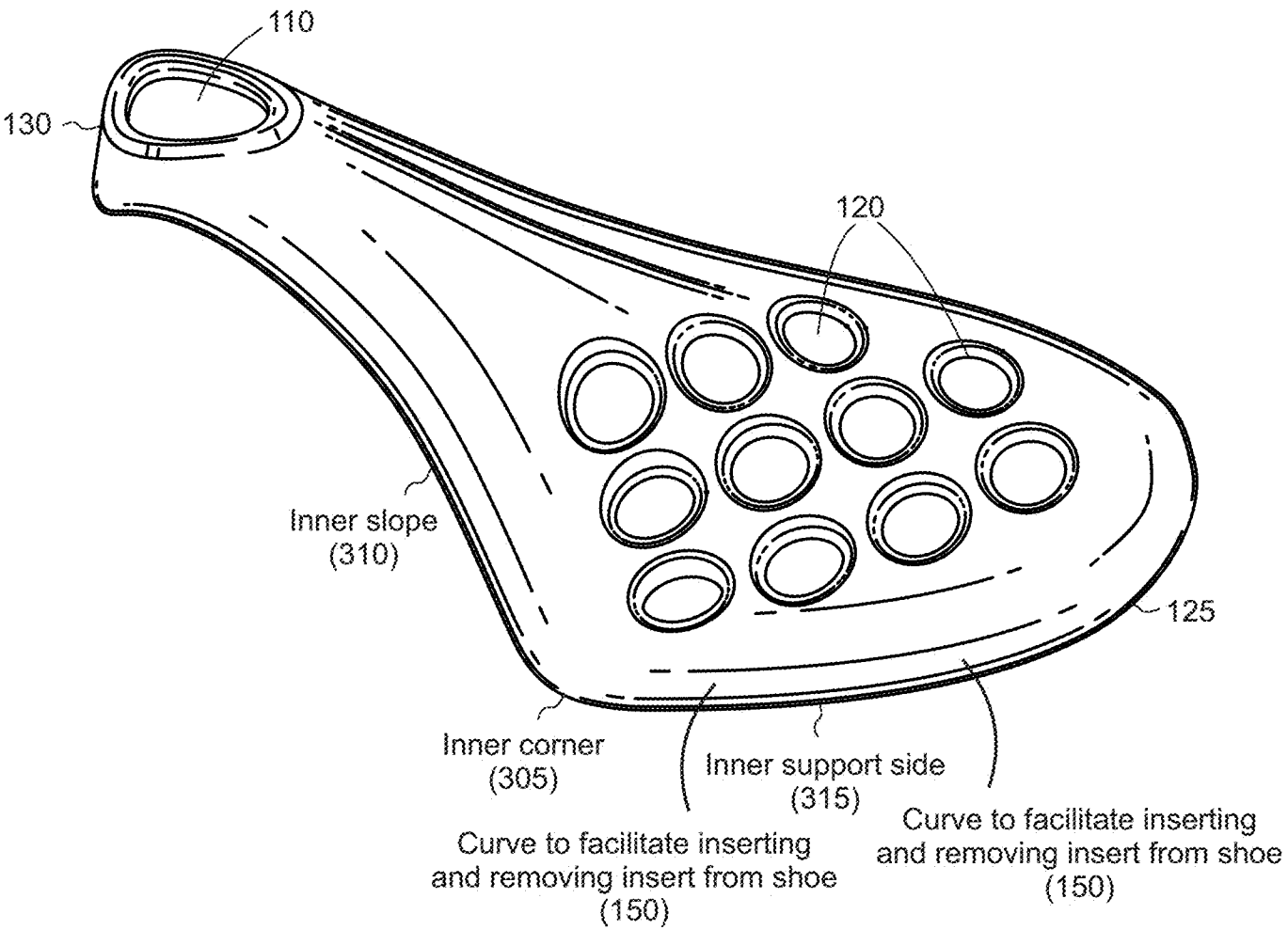
FIG. 3 shows an illustrative representation of an inner side of the shoe insert.

FIG. 3 shows an illustrative representation of an inner portion of the shoe insert 105. The inner portion of the shoe insert includes an inner slope 310 having an arcuate shape that leads to an inner corner 305, and an inner support side 315. Essentially, the inner support side 315 and other inner portions are meant to correspond and engage with an inner portions of a user's shoe, and the outer support side 135 and other outer portions are meant to engage with and support the outer portions of the user's shoe.

Figure 4:
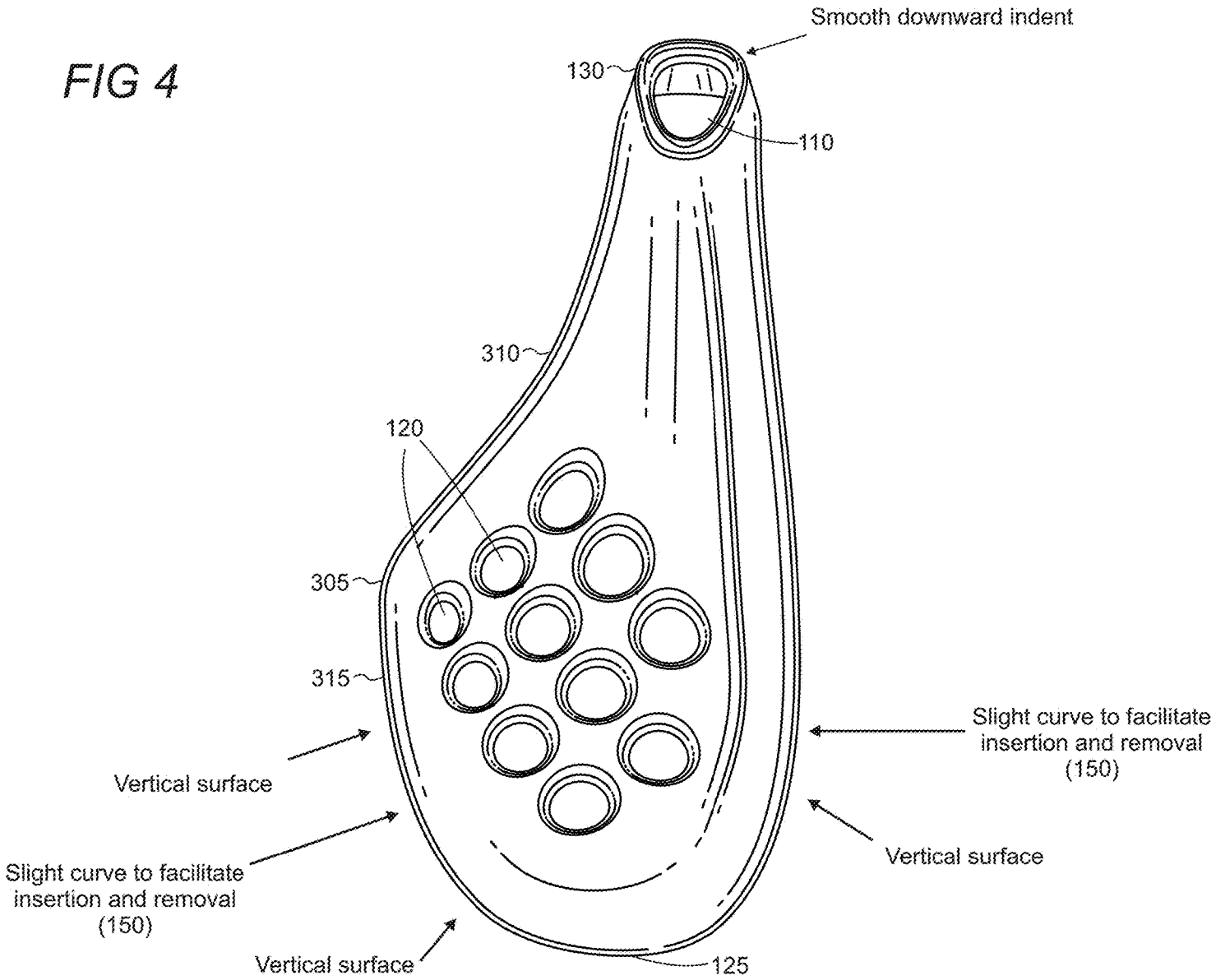
FIG. 4 shows an illustrative representation of a top side of the shoe insert.
Figure 5:
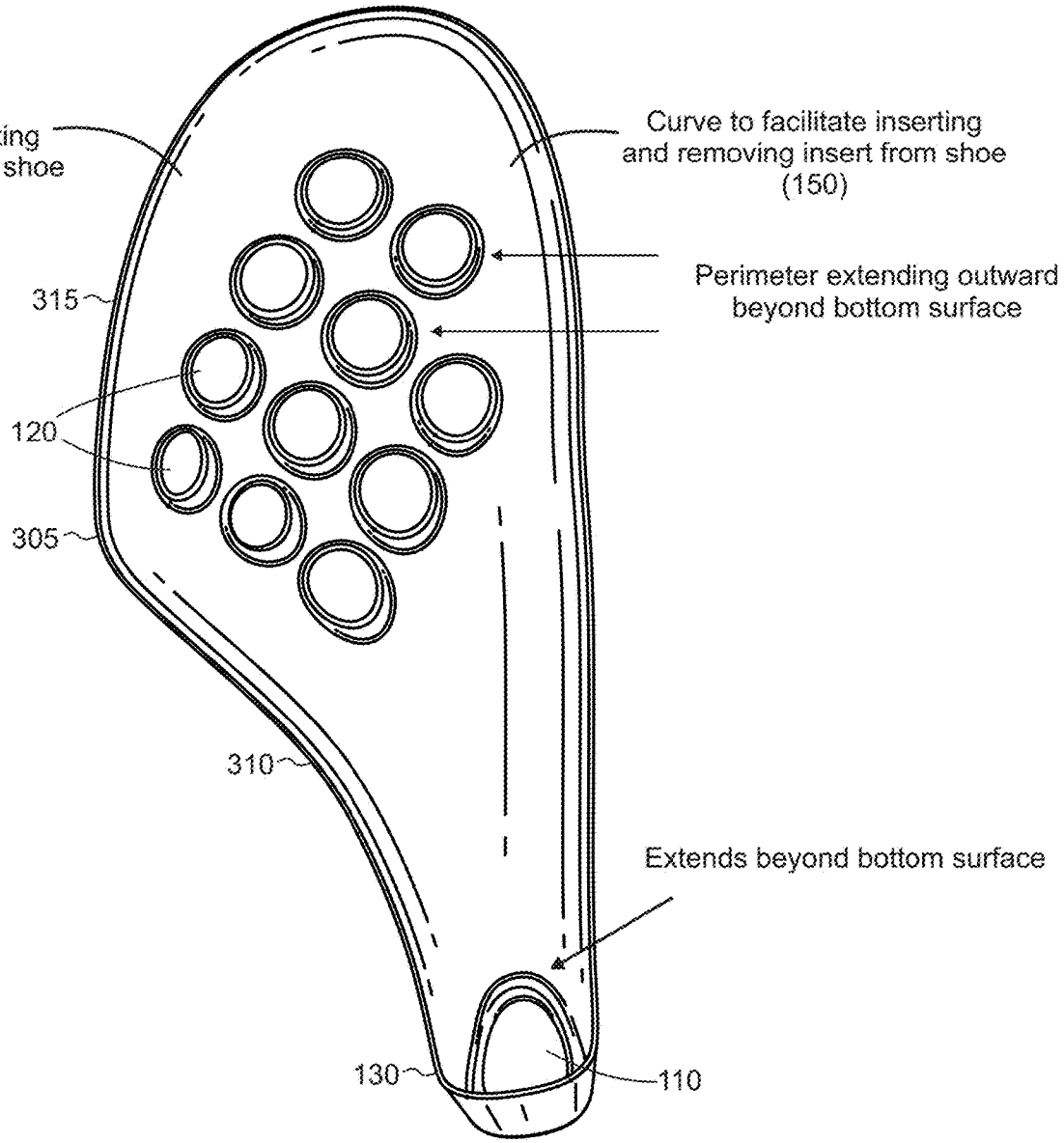
FIG. 5 shows an illustrative representation of a bottom side of the shoe insert.

FIGS. 4 and 5 show illustrative representations of the top and bottom portions of the shoe insert 105, respectively. As shown from the various drawings, the airflow holes 120 have a smooth indentation leading to each respective hole. The airflow holes, however, protrude beyond the bottom surface of the shoe insert's body. Thus, the airflow holes have additional support, making the shoe insert more robust, stronger, and longer lasting. Furthermore, as shown in FIG. 4, the bottom portion of the front 125, inner support side 315, and outer support side 135 are all substantially equivalent vertical surfaces. That is, while the shoe insert slopes downward in creating a shape and size corresponding to a shoe's interior body surface, the bottom or end portion of the shoe insert is substantially vertical all around the shoe. Thus, the shoe insert's end or bottom portion is consistently substantially vertical from the inner support side to the outer support side. This provides the girth that enables the shoe insert to provide shoe support. Similar to the airflow holes 120, the upper opening 110 also has a smooth downward indent from the top surface, extending to a bottom part beyond the shoe insert's bottom surface.

The inner support side 315 and the outer support side 135 each have curved surfaces 150 to facilitate insertion and removal of the shoe insert 105 from a shoe. Even further, the front portion 125 has a curved and off-centered head to also facilitate the insertion and removal of the shoe insert and to provide sufficient front shoe support when inserted in a shoe structure. Thus, the shoe insert is capable of being a universal shoe insert for virtually any, or most, round toe shoes based on the various curved structures implemented. The curves are horizontal in nature (e.g., from side-to-side) and also vertical, as shown more definitively in FIG. 6.

Figure 6:
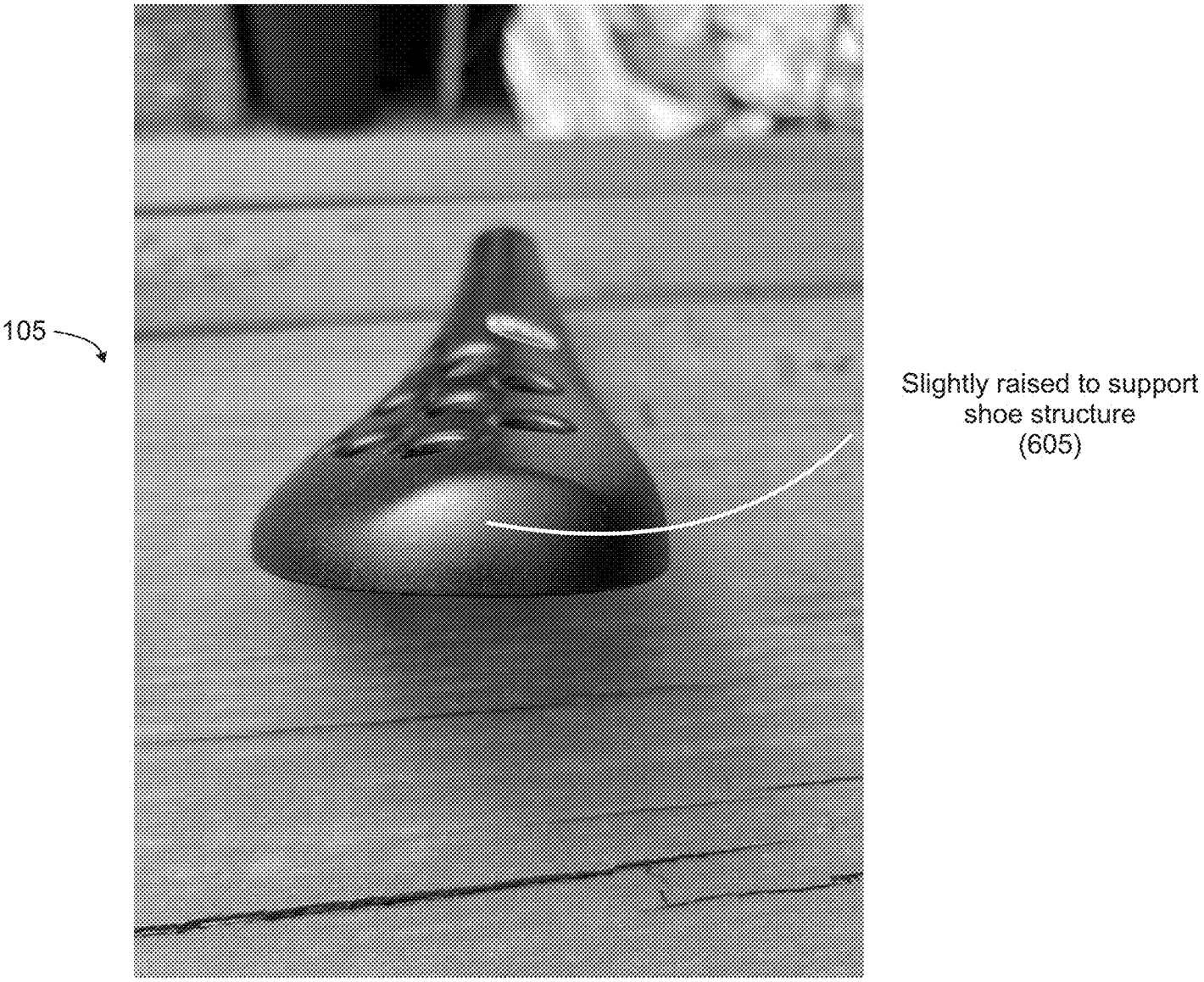
FIGS. 6-12 show various pictorial representations of the shoe insert for additional clarity.
Figure 7:
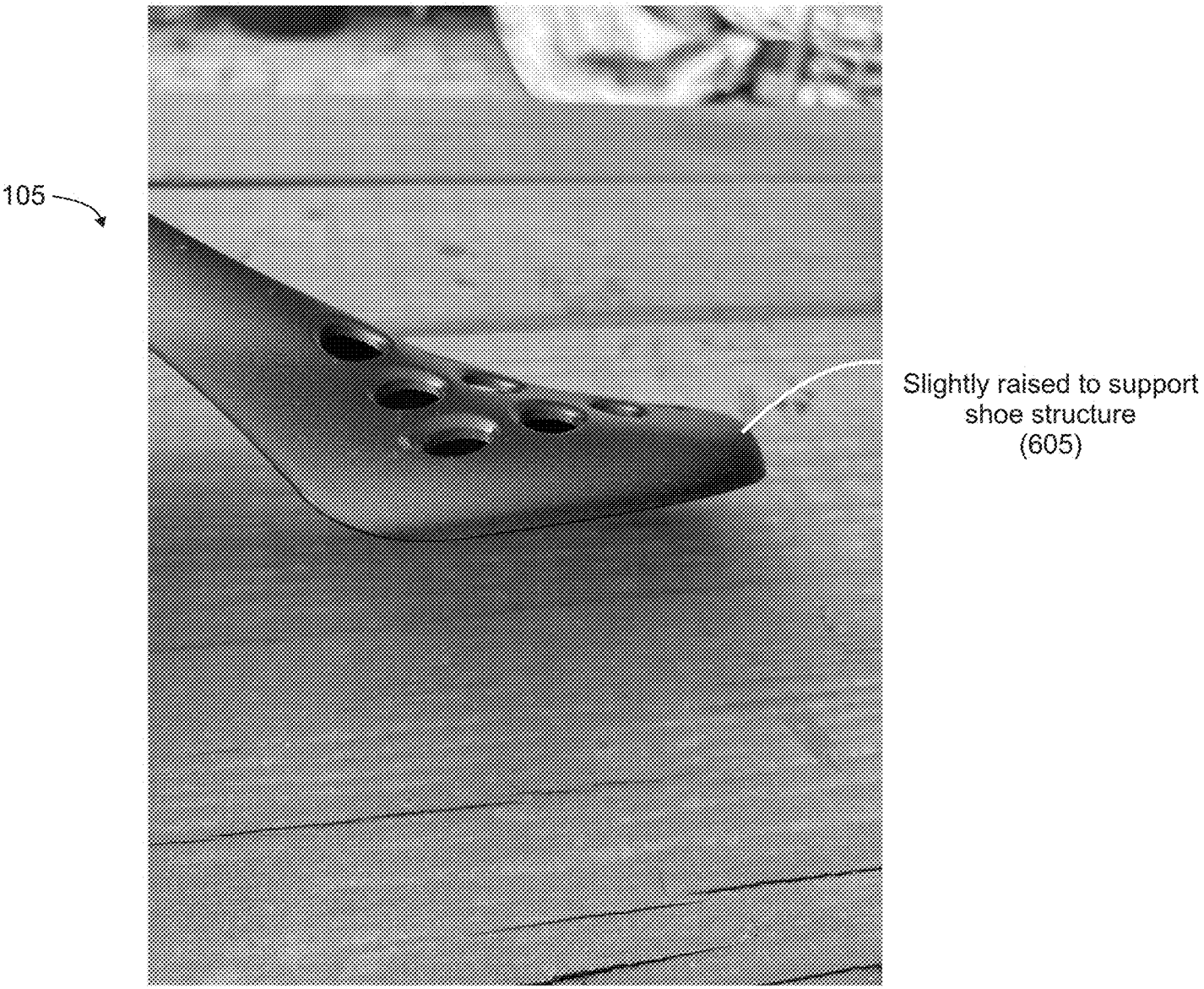
Figure 8:
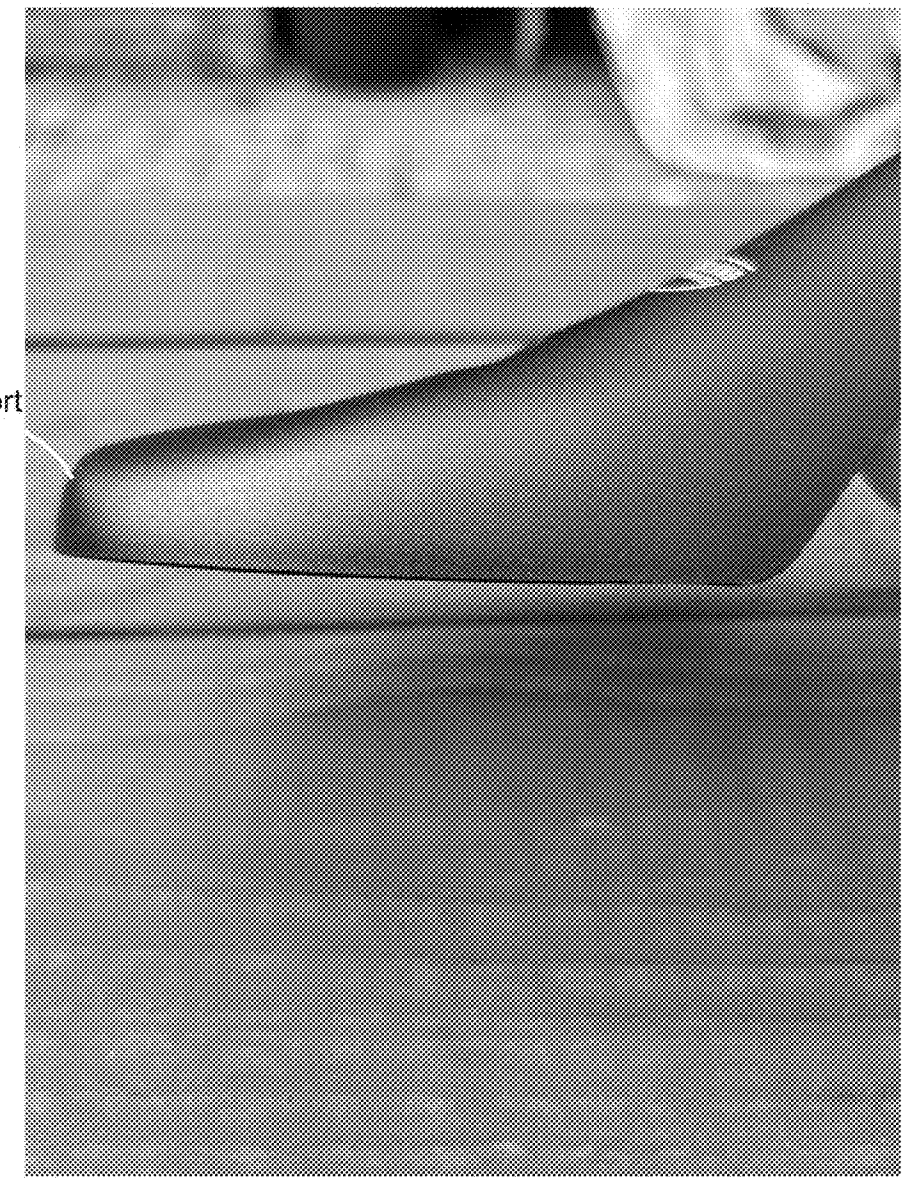
Figure 9:
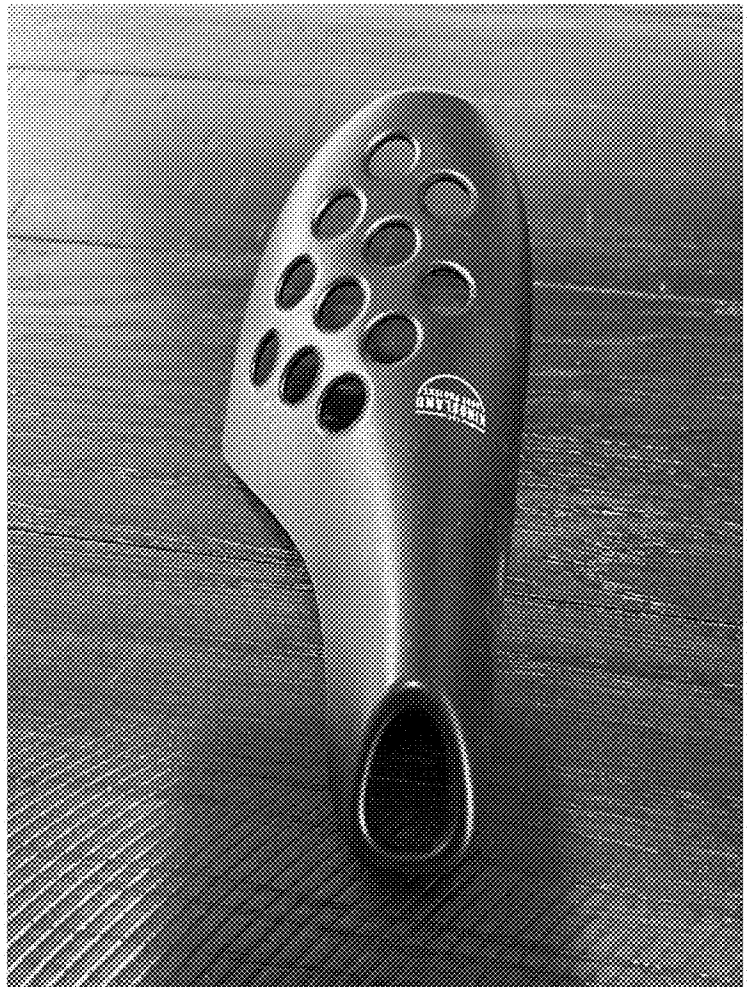
Figure 10:
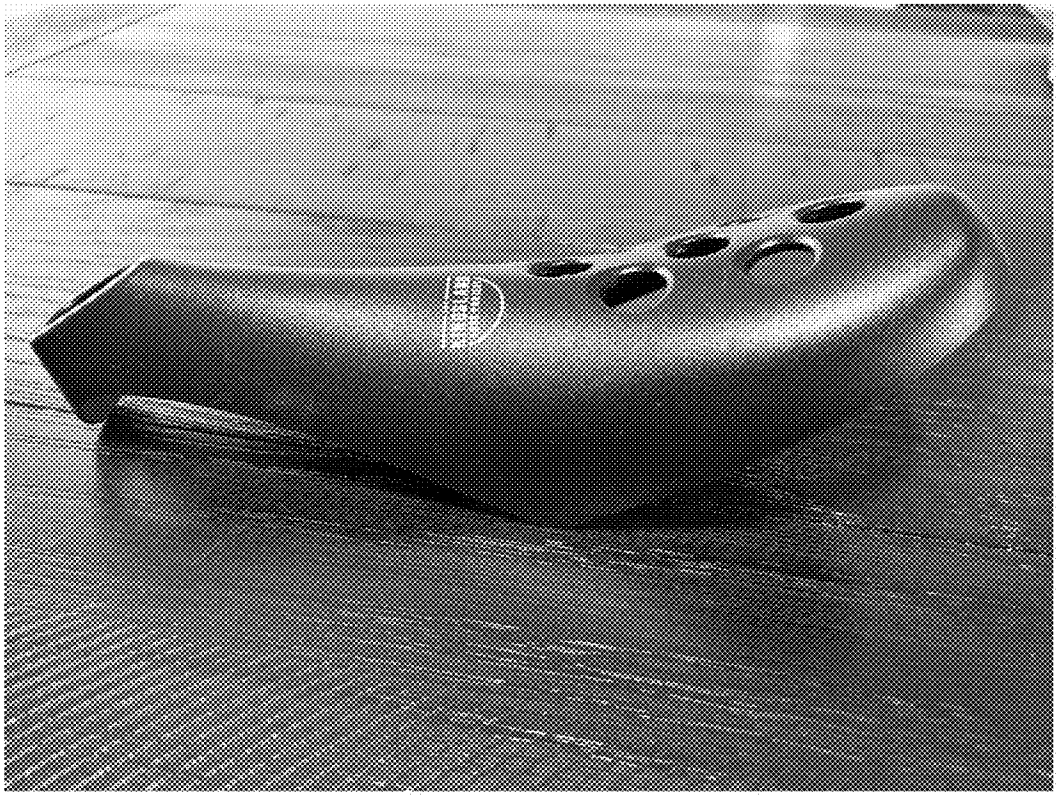
Figure 11:
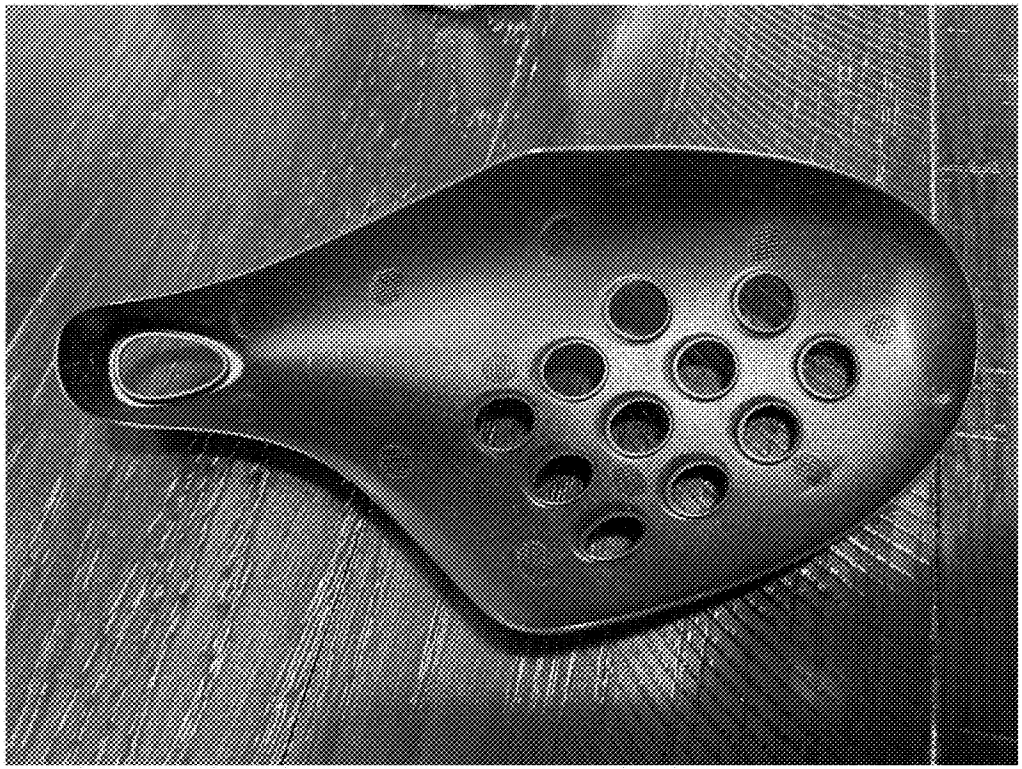
Figure 12:
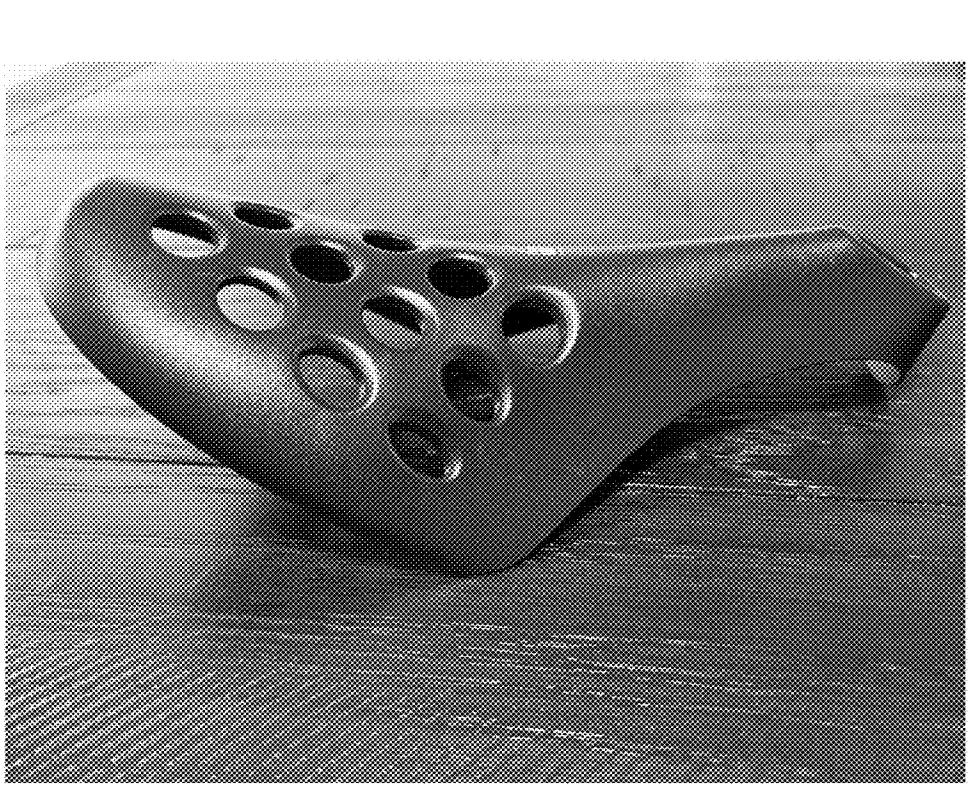

FIGS. 6-12 show various illustrative pictures of the shoe insert 105 to show the actual product with additional definitive clarity. As the shoe insert's features are shape- and contour-centric, the pictures provide additional and definiteness of the shoe's design. For example, FIG. 6 shows the front of the shoe insert's raised front portion 605 which facilitates inserting and removing the shoe insert from the shoe and also supports the front and upper part of a shoe structure when the shoe insert is inserted therein. The curved 150 inner and outer support sides 315, 135, as shown and described with respect to FIGS. 1-5, additionally helps the user easily slide the insert into the shoe and, upon removing the insert, helps prevent the shoe insert from being caught on the shoe's interior materials, such as the insole, laces, and other surfaces.

Various exemplary embodiments are shown and described herein. In one exemplary embodiment, disclosed is a single-piece shoe insert, comprising: a grip portion; outer and inner slopes that extend from the grip portion, wherein the outer and inner slopes extend in a gradual downward direction from the grip portion; outer and inner support sides that respectively extend from the outer and inner slope; and at least one airflow hole on a surface of the shoe insert, at least in between the outer and inner support sides.

As another example, the grip portion forms an obtuse angle, and an upper opening is positioned on the grip portion. In another example, the at least one airflow hole are concentrated on the inner portion of the shoe insert. As another example, the at least one airflow hole is indented from an upper surface of the shoe insert to a bottom surface, and the at least one airflow perimeter extends beyond a bottom surface of the shoe insert. As another example, an end of the shoe insert's inner and outer support sides are substantially vertical and consistently vertical from the inner support side to the upper support side. In another example, a front-most region of the shoe insert has a greater slope than its sides to facilitate insertion and removal of the shoe insert.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. A single-piece footwear insert, comprising:

a grip portion, wherein the grip portion includes an opening, wherein the grip portion is a highest level of the footwear insert;

outer and inner slopes that extend from the grip portion, wherein the outer and inner slopes are opposite edges of the footwear insert that extend in a gradual downward direction from the grip portion, and wherein the outer and inner slopes are positioned at a lower height to the grip portion;

outer and inner support sides that respectively extend from the outer and inner slope, wherein the outer and inner support sides are edges of the footwear insert that gradually meet in a concentric configuration so that the outer and inner support sides at least partially engage with an interior of a piece of footwear in which the footwear insert is placed, and wherein the outer and inner support sides form a different plane relative to the outer and inner slopes; and at least one airflow hole on a surface of the footwear insert, at least in between the outer and inner support sides, wherein the footwear insert is a single unitary layer of material on which is the grip portion, outer and inner slopes, and outer and inner support sides, and wherein the at least one airflow hole is exposed and unobstructed on the single unitary layer's bottom surface and the footwear insert in general such that the at least one airflow hole is observable from the footwear insert's bottom side.

2. The footwear insert of claim 1, wherein the grip portion forms an obtuse angle, and an upper opening is positioned on the grip portion.

3. The footwear insert of claim 1, wherein the at least one airflow hole are concentrated on the inner portion of the footwear insert.

4. The footwear insert of claim 1, wherein the at least one airflow hole is indented from an upper surface of the footwear insert to a bottom surface, and a perimeter of the at least one airflow hole extends beyond a bottom surface of the footwear insert.

5. The footwear insert of claim 1, wherein an end of the footwear insert's inner and outer support sides are substantially vertical and consistently vertical from the inner support side to an upper support side.

6. The footwear insert of claim 1, wherein a front-most region of the footwear insert has a greater slope than its sides to facilitate insertion and removal of the footwear insert.

7. The footwear insert of claim 1, wherein an ending perimeter of the shoe insert's single unitary layer is the outer and inner support sides which separates a top side and a bottom side of the footwear insert's single unitary layer.

8. The footwear insert of claim 1, wherein the outer and inner slopes extend and are connected to the grip portion.

* * * * *